US010123406B1

(12) United States Patent
Melin et al.

(10) Patent No.: US 10,123,406 B1
(45) Date of Patent: Nov. 6, 2018

(54) CYCLOTRON AND METHOD FOR CONTROLLING THE SAME

(71) Applicant: General Electric Company, Schenectady, NY (US)

(72) Inventors: John Hans Melin, Uppsala (SE); Erik Koffmar, Uppsala (SE); Nils Tynelius, Uppsala (SE); Oskar Svedberg, Uppsala (SE)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 15/616,502

(22) Filed: Jun. 7, 2017

(51) Int. Cl.

| | |
|---|---|
| ***H05H 7/14*** | (2006.01) |
| ***H05H 13/00*** | (2006.01) |
| ***H05H 7/10*** | (2006.01) |
| ***H05H 7/08*** | (2006.01) |

(52) U.S. Cl.
CPC ..... *H05H 13/005* (2013.01); *H05H 7/08* (2013.01); *H05H 7/10* (2013.01); *H05H 7/14* (2013.01); *H05H 2007/082* (2013.01)

(58) Field of Classification Search
USPC ..... 315/111.01–111.91
See application file for complete search history.

(56) References Cited

U.S. PATENT DOCUMENTS

| | | | | |
|---|---|---|---|---|
| 5,139,731 | A | 8/1992 | Hendry | |
| 5,898,279 | A | 4/1999 | Ezzedine et al. | |
| 6,445,146 | B1 | 9/2002 | Bergstrom et al. | |
| 8,440,987 | B2 | 5/2013 | Stephani et al. | |
| 2009/0179599 | A1 | 7/2009 | Bertozzi et al. | |
| 2010/0270465 | A1 | 10/2010 | Raptakis et al. | |
| 2013/0033201 | A1* | 2/2013 | Kokubo ..... | H05H 5/06 315/506 |
| 2015/0238918 | A1 | 8/2015 | Khachaturian et al. | |

FOREIGN PATENT DOCUMENTS

| | | | |
|---|---|---|---|
| WO | 2009097536 | A1 | 8/2009 |

* cited by examiner

*Primary Examiner* — Tung X Le
*Assistant Examiner* — Henry Luong
(74) *Attorney, Agent, or Firm* — Dean D. Small; The Small Patent Law Group, LLC

(57) ABSTRACT

Cyclotron includes an acceleration chamber, a vacuum system, an ion source system, and a control system that is configured to determine at least one operating parameter as a particle beam is directed along a beam path of the cyclotron. The control system is configured to decrease a supply of the charged particles for the particle beam based on the at least one operating parameter. The particle beam continues after decreasing the supply of the charged particles. The control system is also configured to increase the supply of the charged particles for the particle beam after a predetermined time period or in response to determining that an amount of gas molecules has reduced based on the at least one operating parameter.

20 Claims, 9 Drawing Sheets

CYCLOTRON AND METHOD FOR CONTROLLING THE SAME

BACKGROUND

The subject matter herein relates generally to cyclotrons and, more specifically, to mechanisms for reducing irradiation of surfaces or components within the cyclotrons.

A cyclotron is a type of particle accelerator in which a beam of charged particles (e.g., H− charged particles or D− charged particles) are accelerated outwardly along a spiral orbit. Cyclotrons may be used to generate radioisotopes (also called radionuclides), which have several applications in medical therapy, imaging, and research, as well as other applications that are not medically related. In such systems, the cyclotron directs the beam into a target material to generate the isotopes.

The cyclotron includes an ion source that provides the charged particles into an acceleration chamber of the cyclotron. The cyclotron uses electrical and magnetic fields to accelerate and guide the charged particles along a predetermined orbit within the acceleration chamber. The magnetic fields are provided by electromagnets and a magnet yoke that surrounds the acceleration chamber. The electrical fields are generated by a pair of radio frequency (RF) electrodes (or dees) that are located within the acceleration chamber. The RF electrodes are electrically coupled to an RF power generator that energizes the RF electrodes to provide the electrical field. The electrical and magnetic fields cause the charged particles to take a spiral-like orbit that has an increasing radius. When the charged particles reach an outer portion of the orbit, the charged particles are stripped of their electrons and form a particle beam that is directed toward the target material for isotope production.

As the charged particles are guided along the orbit, however, the charged particles may collide with other particles, such as residual gas molecules from the ion source or other gas molecules generated by outgassing, degassing, or desorption within the acceleration chamber. An ion may become a neutral particle upon colliding with the other particle. The neutral particle has a trajectory that is essentially tangent to the point in the orbit at which the ion collided with the other particle. The neutral particle then collides with other surfaces in the acceleration chamber, such as the RF electrodes or the extraction system. In the case of RF electrodes, these parts often comprise copper (or other conductive material). When a proton or a neutral hydrogen collides with copper, a relatively large amount of gamma and neutron radiation is generated and long-lived isotopes (e.g., Zn-65) may be generated. This is often the primary source of radiation within an acceleration chamber. Due to the geometry of the cyclotron in the acceleration chamber, the RF electrodes are particularly exposed to the neutral particles.

When service personnel open the acceleration chamber, the personnel are exposed to the activated parts. As such, the accumulation of induced by-products from radiation may be a hazard to individuals. Moreover, an excessive amount of radiation may make it necessary to replace a part earlier than expected.

BRIEF DESCRIPTION

In an embodiment, a cyclotron is provided that includes an acceleration chamber and a vacuum system in flow communication with the acceleration chamber. The vacuum system is configured to evacuate the acceleration chamber.

The cyclotron also includes an ion source system that is configured to provide charged particles to the acceleration chamber. The cyclotron also includes an electrical field system and a magnetic field system that are configured to direct a particle beam formed from the charged particles. The particle beam is directed along a beam path within the acceleration chamber. The cyclotron also includes a control system that is configured to determine at least one operating parameter as the particle beam is directed along the beam path. The control system is configured to decrease a supply of the charged particles for the particle beam based on the at least one operating parameter. The particle beam continues to be directed along the beam path after decreasing the supply of the charged particles. The control system is also configured to increase the supply of the charged particles for the particle beam after a predetermined time period or in response to determining that an amount of gas molecules has reduced based on the at least one operating parameter.

In some aspects, the at least one operating parameter is associated with an amount of gas molecules within the acceleration chamber. For example, the at least one operating parameter may be or include a chamber pressure of the acceleration chamber.

In some aspects, decreasing the supply of the charged particles includes reducing the supply of charged particles by at least 20%.

In some aspects, the control system is configured to operate the cyclotron in accordance with a planned operating mode. The control system interrupts the planned operating mode when decreasing the supply of the charged particles.

In some aspects, at least one of decreasing or increasing the supply of the charged particles by the control system is based upon one or more parts of the cyclotron that have been recently replaced. The control system at least one of detects the one or more parts that have been replaced or receives user inputs indicating the one or more parts that have been replaced.

In some aspects, the at least one operating parameter includes at least one of a chamber pressure of the acceleration chamber, an ion source current, one or more beam currents detected along or near the beam path, a beam profile of the particle beam, or a beam quality factor.

In some aspects, the operating parameter includes at least one of a chamber pressure of the acceleration chamber or a beam current at an extraction system.

In some aspects, decreasing or increasing the supply of the charged particles by the control system includes at least one of changing a current of the ion source system, a voltage of the ion source system, a pressure of a gas in the ion source system, or a flow rate of the gas in the ion source system.

In some aspects, after decreasing the supply of the charged particles a first time, the control system is configured to decrease the supply of the charged particles a second time in response to determining that the operating parameter did not substantially change after decreasing the supply of the charged particles the first time. For example, the supply may be decreased the second time if, after a designated time period, a chamber pressure has increased. The supply may also be decreased the second time if, after a designated time period, a chamber pressure has not decreased below a predetermined level.

In some aspects, the cyclotron also includes a user interface that is configured to notify a user of the cyclotron that the cyclotron operated at a reduced supply of the charged particles.

In some aspects, the cyclotron also includes a user interface that is configured to receive user inputs, the control system configured to override, based upon the user inputs, decreasing the supply of the charged particles based on the at least one operating parameter.

In an embodiment, a cyclotron is provided that includes an acceleration chamber, a vacuum system in flow communication with the acceleration chamber and configured to evacuate the acceleration chamber, and an ion source system configured to provide charged particles to the acceleration chamber. The cyclotron also includes an electrical field system and a magnetic field system configured to direct a particle beam formed from the charged particles. The particle beam is configured to be directed along a beam path within the acceleration chamber. The cyclotron also includes a control system configured to determine a chamber pressure of the acceleration chamber as the particle beam is directed along the beam path. The control system is configured to decrease supply of the charged particles to the acceleration chamber in response to determining that the chamber pressure is excessive. The control system is configured to increase the supply of the charged particles to the acceleration chamber in response to determining that the chamber pressure has reduced to an acceptable value.

In some aspects, the chamber pressure may have reduced to an acceptable value if the chamber pressure is equal to or less than a designated value within a designated time period.

In some aspects, decreasing the supply of the charged particles includes reducing the supply of charged particles by at least 20%.

In some aspects, decreasing or increasing the supply of the charged particles by the control system is also based on an operating parameter. The operating parameter includes at least one of an ion source current, one or more beam currents detected along or near the beam path, a beam profile of the particle beam, or a beam quality factor.

In some aspects, decreasing or increasing the supply of the charged particles by the control system includes at least one of changing a current of the ion source system, a voltage of the ion source system, a pressure of a gas in the ion source system, or a flow rate of the gas in the ion source system.

In some aspects, the control system is configured to operate the cyclotron in accordance with a planned operating mode. The control system is configured to interrupt the planned operating mode when decreasing the supply of the charged particles.

In some aspects, after decreasing the supply of the charged particles a first time, the control system is configured to decrease the supply of the charged particles a second time in response to determining that the chamber pressure did not substantially change after decreasing the supply of the charged particles the first time.

In an embodiment, a method is provided that includes directing a particle beam of charged particles in an acceleration chamber using an electrical field system and a magnetic field system. The acceleration chamber is evacuated by a vacuum system. The charged particles are supplied by an ion source system to the acceleration chamber. The method includes monitoring at least one operating parameter as the particle beam is directed within the acceleration chamber. The at least one operating parameter is associated with an amount of gas molecules within the acceleration chamber. The method also includes decreasing a supply of the charged particles to the acceleration chamber based upon the at least one operating parameter. The particle beam continues to be directed along the beam path after decreasing the supply of the charged particles. The method also includes increasing the supply of the charged particles after a predetermined time period or in response to determining that the amount of gas molecules has reduced based on the at least one operating parameter.

In some aspects, decreasing the supply of the charged particles includes reducing the supply of charged particles by at least 20%.

In some aspects, decreasing or increasing the supply of the charged particles includes at least one of changing a current of the ion source system, a voltage of the ion source system, a pressure of a gas in the ion source system, or a flow rate of the gas in the ion source system.

In some aspects, the particle beam is directed in accordance with a planned operating mode, the planned operating mode being interrupted when decreasing the supply of the charged particles.

In an embodiment, a control system for controlling operation of a cyclotron is provided. The control system may include, for example, a processing unit having one or more processors that are configured to execute programmed instructions stored in memory. Alternatively or in addition to the above, the processing unit is a hard-wired device (e.g., electronic circuitry) that performs the operations based on hard-wired logic. The control system is configured to direct a particle beam of charged particles in an acceleration chamber using an electrical field system and a magnetic field system. The acceleration chamber is evacuated by a vacuum system. The control system may be configured to control a supply of the charged particles using an ion source system. The control system is also configured to receive data regarding at least one operating parameter. The control system is configured to decrease the supply of charged particles for the particle beam based on the at least one operating parameter. The control system continues to direct the particle beam after the control system decreases the supply of the charged particles. The control system is also configured to increase the supply of the charged particles for the particle beam after a predetermined time period or in response to determining that the amount of gas molecules has reduced based on the at least one operating parameter.

In an embodiment, a non-transitory computer readable medium is provided that includes stored programmed instructions (e.g., for controlling one or more operations of a cyclotron). A processing unit is configured to execute the programmed instructions to monitor at least one operating parameter as the particle beam is directed within the acceleration chamber. The at least one operating parameter is associated with an amount of gas molecules within the acceleration chamber. The processing unit is also configured to execute the programmed instructions to decrease a supply of the charged particles to the acceleration chamber based upon the at least one operating parameter. The particle beam continues to be directed along the beam path after decreasing the supply of the charged particles. The processing unit is also configured to execute the programmed instructions to increase the supply of the charged particles after a predetermined time period or in response to determining that the amount of gas molecules has reduced based on the at least one operating parameter.

DETAILED DESCRIPTION

Figure 1:
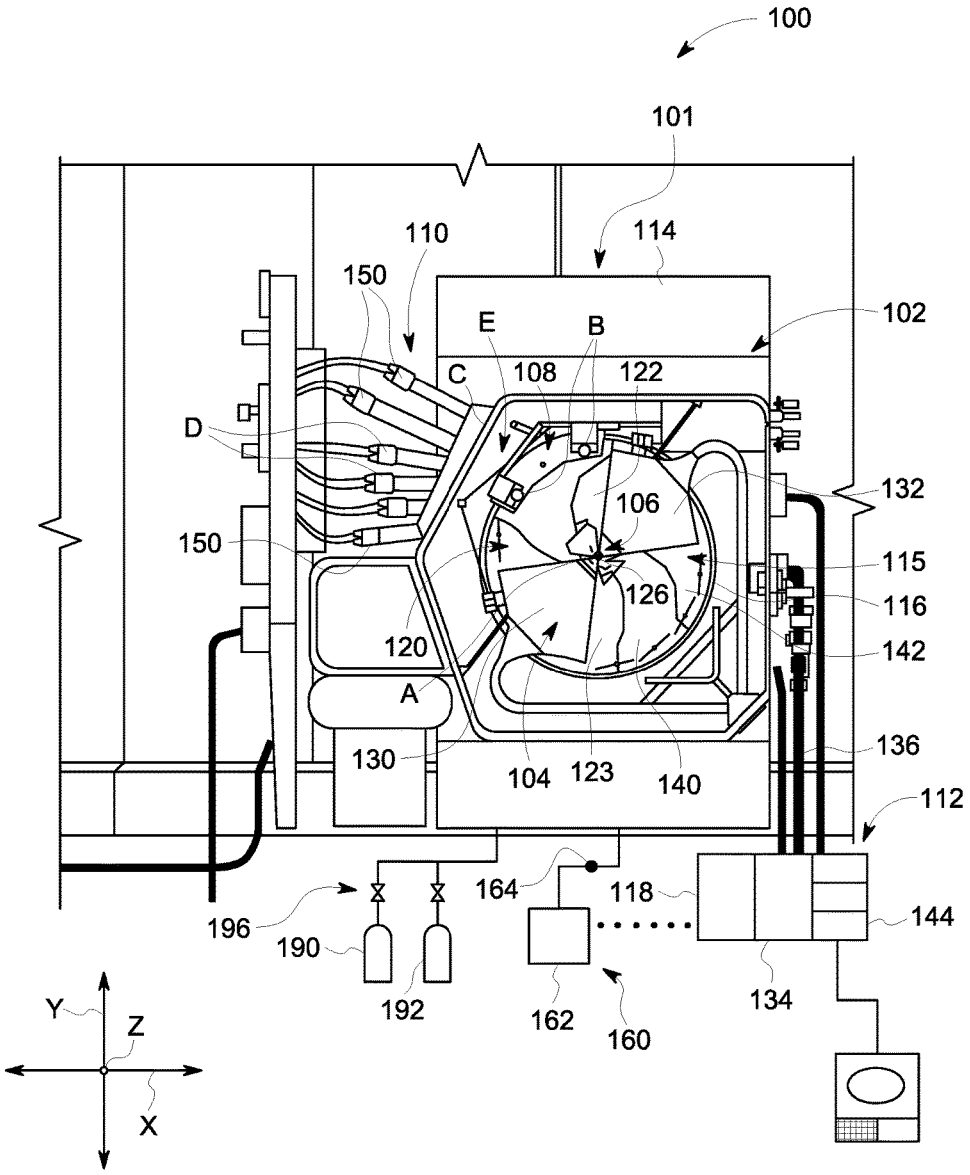
FIG. 1 is a side view of a radioisotope production system having a cyclotron in accordance with one embodiment.

Embodiments set forth herein include cyclotrons, control systems of cyclotrons, and methods of making or using the same. In particular embodiments, the cyclotron is part of a radioisotope production system. Embodiments are configured to determine at least one operating parameter and control operation of the cyclotron based on the at least one operating parameter. The at least one operating parameter may be associated with an amount of gas molecules within the acceleration chamber. Chamber pressure is one example of an operating parameter that may be monitored by one or more embodiments. A chamber pressure that is relatively high is associated with a larger amount of residual gas molecules within the acceleration chamber that may collide with the charged particles. Due to these collisions, the residual gas molecules are generally unwanted and lower chamber pressures are desired.

Other operating parameters that may be monitored include an ion source current, a beam current that is detected at a designated location along or near the beam path (e.g., beam current at an extraction system), a beam profile of the particle beam, or a beam quality factor. More than one operating parameter may be monitored. More specifically, decision-making for changing operation of the cyclotron may be based on a single operating parameter or on multiple operating parameters. For example, the cyclotron may change to a different operating mode if the operating parameter exceeds a designated value. In some embodiments, the decision-making is determined by a multi-variable function that is based on multiple operating parameters and, optionally, other factors. The multi-variable function (e.g., objective function, cost function, profit function, or the like) may be used to find an improved outcome. As used herein, the term "improved" means more desirable. An improved outcome may be one that is increased or reduced. The term does not require, although it may include, that the improved metric or outcome be optimized (e.g., maximized or minimized). Other factors that the multi-variable function may be based on include cost of replacement parts, cost of target material, regulations, etc.

For simplicity, the following description may only refer to an "operating parameter." Nonetheless, it should be understood that the term "operating parameter" may be replaced with "at least one operating parameter." For example, "the operating parameter" may be replaced with "the at least one operating parameter."

The operating parameter is monitored during operation of the cyclotron. For example, an operating parameter may be monitored as a particle beam is generated and directed by the cyclotron. As used herein, the terms "monitor" or "monitoring" or derivatives thereof includes either continuous, periodic, or aperiodic monitoring. For instance, the operating parameter may be continuously monitored by determining the operating parameter at least every 1.0 second (e.g., every 1.0 second, every 0.5 second, every 0.1 second, or more frequently). The operating parameter may be monitored less frequently by determining the operating parameter at most once every 20 seconds (e.g., once every 30 seconds, once every 60 seconds, or less frequently). An operating parameter may also be monitored aperiodically (e.g., not at regular intervals). For example, the operating parameter may only be monitored when a designated event occurs, such as when a beam current is determined to be excessive.

Embodiments may change or adjust operation of the cyclotron based on the operating parameter. For example, embodiments may decrease production of the charged particles that are used to generate the particle beam. The production may be decreased by changing an electrical characteristic of the ion source system (e.g., current or voltage) and/or by changing a gas characteristic (e.g., flow rate or pressure). In particular embodiments, a number of operating parameters are monitored. Such embodiments may be similar to embodiments described in U.S. patent application Ser. No. 15/044,397, filed on Feb. 16, 2016, which is hereby incorporated by reference in its entirety.

One or more embodiments are configured to produce radioisotopes (also called radionuclides) that may be used in medical imaging, research, and therapy, but also for other applications that are not medically related, such as scientific research or analysis. When used for medical purposes, such as in Nuclear Medicine (NM) imaging or Positron Emission Tomography (PET) imaging, the radioisotopes may also be called tracers. By way of example, a radioisotope production system may generate protons to make $^{18}F^{-}$ isotopes in liquid form, $^{11}C$ isotopes as $CO_2$, and $^{13}N$ isotopes as $NH_3$. The target material used to make these isotopes may be enriched $^{18}O$ water, natural $^{14}N_2$ gas, $^{16}O$-water. The radioisotope production system may also generate protons or deuterons in order to produce $^{15}O$ gases (oxygen, carbon dioxide, and carbon monoxide) and $^{15}O$ labeled water.

A technical effect of one or more embodiments is a more efficient operation of the cyclotron compared to a cyclotron that does not automatically interrupt operation of the cyclotron. Alternatively or in addition to the above, a technical effect of one or more embodiments may be a reduced level of exposure to individuals near the cyclotron. Alternatively or in addition to the above, a technical effect of one or more embodiments may be a reduced frequency at which the cyclotron undergoes maintenance. Alternatively or in addition to the above, a technical effect of one or more embodiments may be replacing parts of the cyclotron fewer times and/or at a reduced frequency.

Parts of the cyclotron that may be replaced during maintenance or when the cyclotron is serviced include probes (e.g., flip-in probes), interception panels (e.g., neutral beam baffles), dummy dees, dee points, clamps, cables, hardware, fittings, hoses, valves, filaments, foils, carousels, carriers, collimators, air filters, pumps, sensors (e.g., Penning or Pirani), interior electromechanical motors including piezoelectric elements (e.g., piezoelectric beam extraction driver), and the like. Such parts may be referred to as "replaceable cyclotron parts." Grounded plates that positioned adjacent to the dees may also be replaced. The grounded plates and dees form a variable capacitor that can be used to tune the resonance frequency.

Replaceable cyclotron parts may also be from the extraction system, such as foils, foil holders (e.g., carousels), switches, arms, or motors that move the foils, foil holders, and arms. Parts may include parts of the ion source system, such as anodes, cathodes, and a body that includes the opening through which the charged particles are provided. For example, in some embodiments, the ion source system includes a tube having a slit through which the charged particles are pulled. The ion source system may also include a larger structure (e.g., block) that holds other parts.

In certain embodiments, the replaceable cyclotron parts are at least partially exposed in the acceleration chamber and/or are located within or near the beam path. At least some of the replaceable cyclotron parts may undergo a greater than average amount of outgassing, degassing, or desorption during operation of the cyclotron. For example, the heat generated by the cyclotron and/or stray particles may cause outgassing, degassing, or desorption, especially from newer parts.

Figure 10:
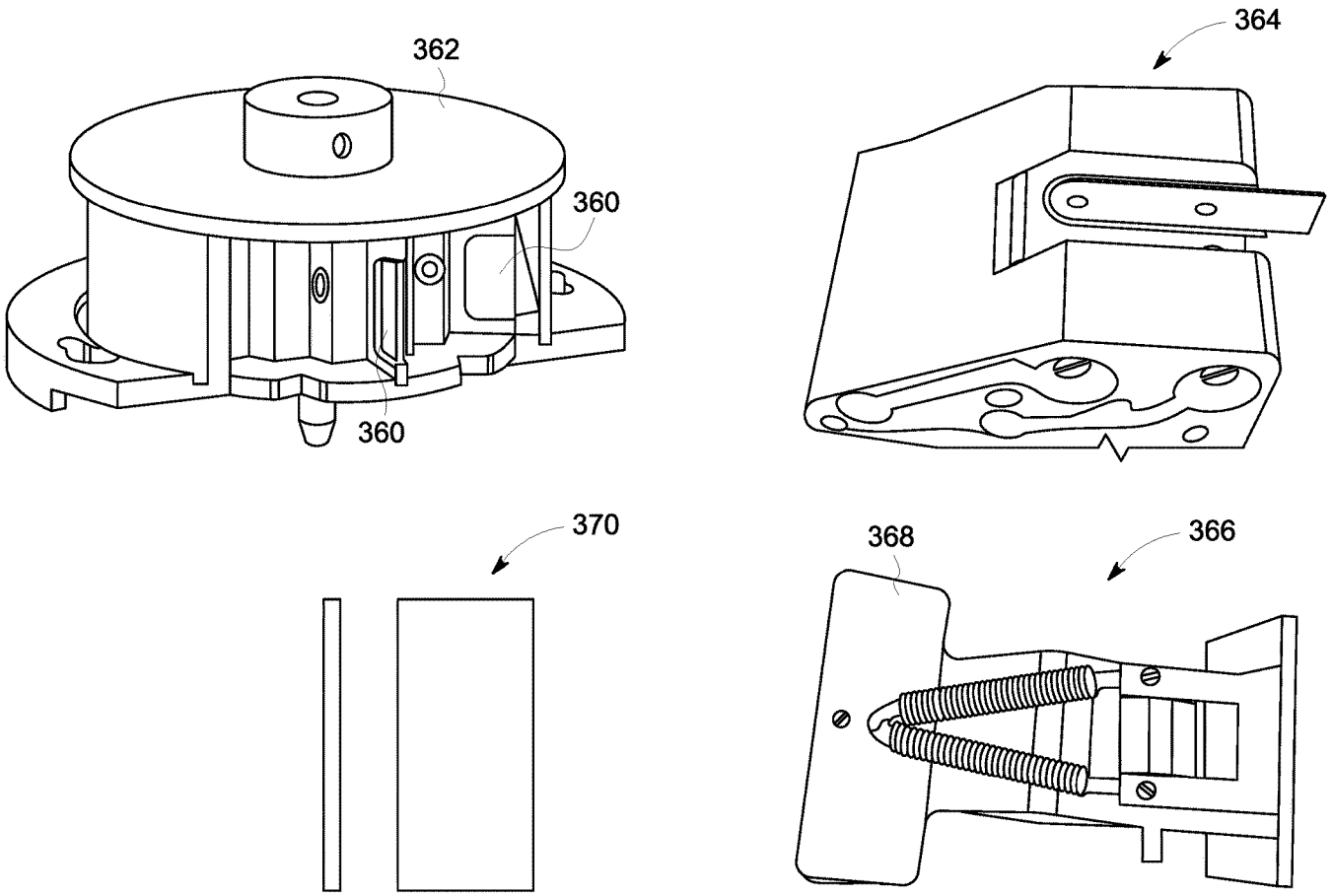
FIG. 10 illustrates cyclotron parts that may be replaced in accordance with an embodiment.

FIG. 10 illustrates examples of at least some of the parts that may be replaced. The parts include a stripping foil 360 and a foil holder 362, which is a carousel in FIG. 10 that is capable of holding multiple foils 360. The parts also include a source body 364 that is configured to hold one or more anodes of the ion source assembly. The parts also include a flap unit 366, which includes a grounded plate 368 that may be used to tune a resonance frequency of the cyclotron. The parts also include interception panels 370 (e.g., neutral beam baffles).

It is possible that an approximate amount of gas generation that may occur from a newly added cyclotron part may be known or estimated based on the composition of the newly added cyclotron part. In such instances, control of the cyclotron may be adjusted to account for the gas generation. In some embodiments, a control system may be configured to control the cyclotron in a predetermined manner to account for expected gas generation from the new cyclotron part.

The following detailed description of certain embodiments will be better understood when read in conjunction with the appended drawings. To the extent that the figures illustrate diagrams of the functional blocks of various embodiments, the functional blocks are not necessarily indicative of the division between hardware circuitry. For example, one or more of the functional blocks (e.g., processors, memories) may be implemented in a single piece of hardware (e.g., a general purpose signal processor or a block of random access memory, hard disk, or the like) or multiple pieces of hardware. Similarly, the programs may be standalone programs, may be incorporated as subroutines in an operating system, may be functions in an installed software package, and the like. It should be understood that the various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

FIG. 1 is a side view of a radioisotope production system 100 having a cyclotron 101 in accordance with one embodiment. In the illustrated embodiment, the cyclotron 101 is a compact isochronous sector focused cyclotron. It should be understood, however, that embodiments may be suitable for other cyclotron configurations or other radioisotope production systems. The cyclotron 101 is configured to form a particle beam from charged particles and direct the particle beam along an orbit or beam path. The accelerated particles may include, for example, H− or D− charged particles, which may be transformed to protons and deuterons, respectively, through an extraction process. In some embodiments, the cyclotron 101 may be configured to operate with H− charged particles in a first mode and D− charged particles in a second mode. In other embodiments, the cyclotron 101 may form a particle beam with positively-charged particles.

The radioisotope production system 100 (or the cyclotron 101) includes a plurality of sub-systems, which may be referred to simply as systems or assemblies. The systems of the cyclotron 101 include a magnetic field system 102, an electrical field system 104 (e.g., radio-frequency (RF) system), and an ion source system 106. The radioisotope system also includes an extraction system 108 and a target system 110. Optionally, the radioisotope production system 100 may include a radiochemistry system that is configured to purify the target material to provide radionuclides. It should be understood that the above list of sub-systems is not intended to be limiting and that embodiments may include fewer or additional sub-systems. Moreover, one or more sub-systems may share components and/or one or more sub-systems may perform functions that other sub-systems are described herein as performing. The radioisotope production system 100 and/or the cyclotron 101 also include a control system 112 for controlling operation of the various sub-systems.

The magnetic field system 102 generates a magnetic flux (or magnetic field) that directs the charged particles along a beam path. The beam path in the illustrated embodiment is a spiral-like orbit that cycles around a central axis 126. The magnetic field system 102 includes a magnet yoke 114, an electromagnet or coils 116, and a magnet power supply (MPS) 118. The MPS 118 may be considered a portion of the control system 112. In FIG. 1, only an open-sided section 115 of the magnet yoke 114 is illustrated. Another section (not shown) may be positioned side-by-side with the section 115 to enclose an acceleration chamber 120 where the charged particles are directed along the beam path.

The magnet yoke 114 may comprise, for example, a large body of industrial steel. The magnet yoke 114 may form magnet poles 122 that comprise, for example, a high quality steel having a low carbon content. The magnet poles 122 include pole tops 123 that may be plated with a thin layer of copper for providing conductance for eddy currents generated along the pole surface. In FIG. 1, the magnet yoke 114 is oriented such that a mid-plane is vertical and extends parallel to X and Y axes. In some embodiments, the pole tops 123 include hills 140 and valleys 142 such that a pole gap between the opposing pole tops 123 varies. When the yoke sections oppose each other and are closed for operation, the pole tops 123 are separated by an inner spatial region where the charged particles are directed along the particle orbit.

Figure 8:
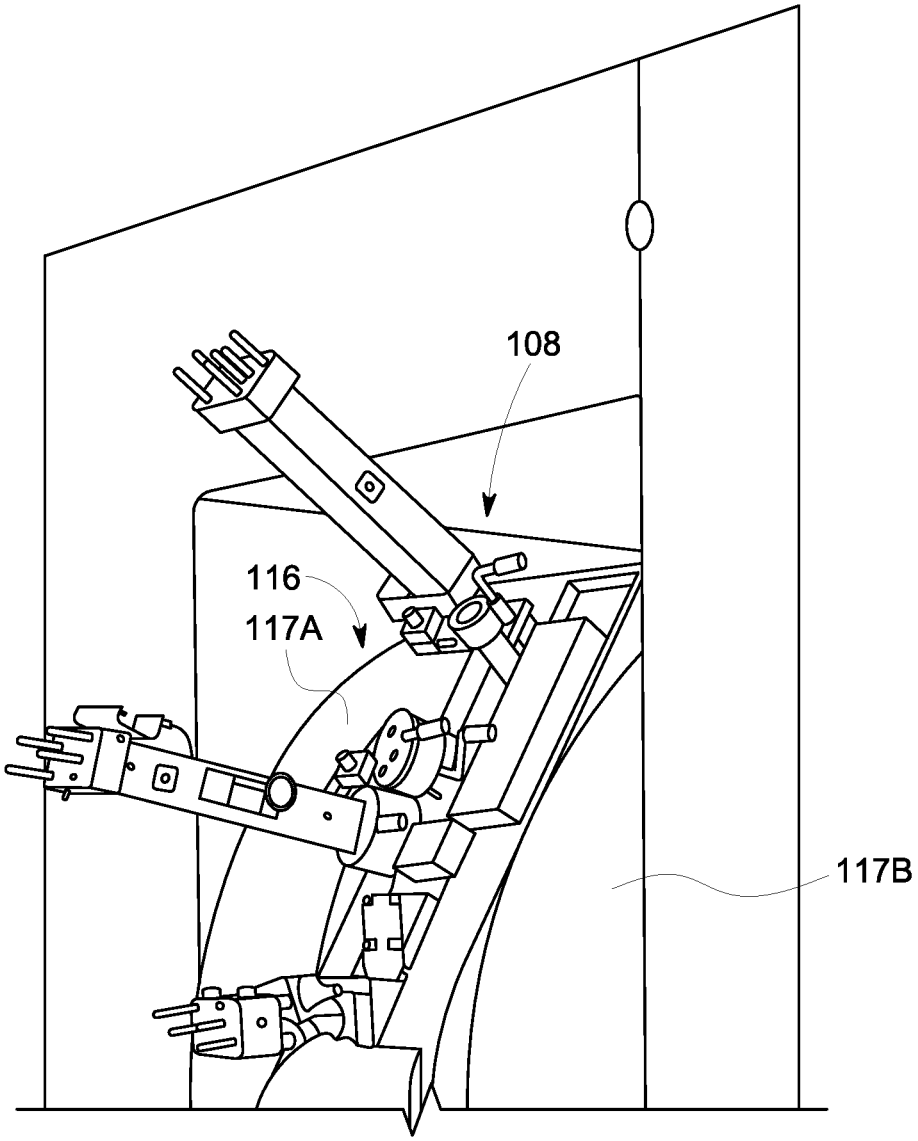
FIG. 8 illustrates an outer portion of an electromagnet for the cyclotron of FIG. 1 in accordance with an embodiment.

Only an outer portion of the electromagnet 116 is shown in FIG. 1. The electromagnet 116 is also shown in FIG. 8 and includes a pair of coils 117A, 117B. FIG. 8 is a perspective view of one side of the radioisotope production system 100 that includes the extraction system 108. The coils 117A, 117B having a number of turns about the central axis 126 (FIG. 1).

Returning to FIG. 1, the MPS 118 may be a constant current power supply. By way of example, the MPS 118 may supply up to 500 A or more of current to the coils 117A, 117B. This current is hereinafter referred to as a drive current or a magnet current. A strength of the magnetic flux within the acceleration chamber 120 increases as the drive current increases. The strength of the magnetic flux decreases, however, as the magnetic yoke 114 and, particularly, the poles 122 increase in temperature. The changing magnetic flux may alter a beam quality of the particle beam. Embodiments may be configured to control the drive current to control the beam quality for a desired production of radioisotopes and/or performance of the particle beam. Such embodiments may be similar to embodiments described in U.S. patent application Ser. No. 15/044,397, filed on Feb. 16, 2016, which is hereby incorporated by reference in its entirety.

The MPS 118 may include, for example, a transformer, a thyristor bridge, an LC filter, a DC current transformer, and control circuits. Although specific examples are given above, it should be understood that the magnetic field system 102 may operate with different parameters and/or with different components.

The electrical field system 104 is configured to produce an acceleration voltage that oscillates at a high frequency (e.g., RF). In the illustrated embodiment, the electrical field system 104 is configured to accelerate the particle beam within the acceleration chamber 120 by providing the charged particles four energy steps per revolution. The electrical field system 104 may also be configured to draw charged particles from the ion source system 106. The electrical field system 104 includes a resonator system formed by two electrodes (or dees) 130, 132 that are positioned within the acceleration chamber 120. The electrodes 130, 132 form respective quarter-wave lines and are inductively coupled to each other. However, it is understood that there may be other types of coupling between dees and more or less than four energy steps per revolution based on the number of dees.

The electrical field system 104 also includes a power generator 134 (or RFPG) and a feeder cable 136 that transmits RF power from the power generator 134 to the electrodes 130, 132. The power generator 134 generates an RF signal and may also amplify the RF signal to a power level necessary to support losses of the electrical field system 104. Although specific examples are given above, it should be understood that the electrical field system 104 may operate with different power parameters and/or with different components. The magnetic field system 102 and the electrical field system 104 are controlled by the control system 112 as described herein.

During operation of the radioisotope production system 100, charged particles are provided into the acceleration chamber 120 through the ion source system 106. The ion source system 106 may include one or more sources of gas. For example, the ion source system 106 may include a first source 190 having a first gas (e.g., hydrogen gas $H_2$) and a second source 192 having a second gas (e.g., deuterium gas $D_2$). The charged particles may be supplied through an opening or slit 194 (shown in FIG. 3) that is located at the midplane and proximate to the central axis 126. The slit 194 may represent the starting point of the particle beam. One or more valves 196 of the ion source system 106 may control a flow rate or pressure of the gas that is used to generate the charged particles.

After the charged particles are provided into the acceleration chamber 120, the magnetic field system 102 and the electrical field system 104 are configured to generate respective fields that cooperate in producing a particle beam of the charged particles. The charged particles are accelerated and guided within the acceleration chamber 120 along the beam path that coincides with or extends generally along the midplane.

During operation of the radioisotope production system 100, the acceleration chamber 120 is in a vacuum (or evacuated) state and experiences a large magnetic flux. For example, an average magnetic field strength between pole tops in the acceleration chamber 120 may be at least 1 Tesla. After the particle beam is generated, the pressure of the acceleration chamber 120 may be, for example, $5\times10^{-7}\pm2\times10^{-7}$ millibar (or $5\times10^{-5}\pm2\times10^{-5}$ Pa). Again, the above values are only examples and various embodiments may operate within different parameters.

The vacuum state is provided by the vacuum system 160. The vacuum system 160 includes a pump assembly 162 and a sensor assembly (or gauge assembly). The pump assembly 162 may include one or more pumping devices (or pumps) that effectively evacuate the acceleration chamber 120 so that the cyclotron 101 has a desired operating efficiency. The pump assembly 162 may include one or more momentum-transfer type pumps, positive displacement type pumps, and/or other types of pumps. For example, the pump assembly 162 may include one or more diffusion pumps, one or more ion pumps, one or more cryogenic pumps, one or more rotary vane or roughing pumps, and/or one or more turbomolecular pumps. Thus, the pump assembly 162 may include a plurality of one type of pump or a combination of pumps using different types. As shown in FIG. 1, the pump assembly 162 is in flow communication with the acceleration chamber 120. Although not shown, the vacuum system 160 and/or pump assembly 162 may include other components for removing the gas particles, such as additional pumps, tanks or chambers, conduits, liners, valves including ventilation valves, gauges, seals, oil, and exhaust pipes.

The vacuum system 160 also includes the sensor assembly 164 to monitor operation of the pump assembly 162 and/or to monitor the evacuated state of the acceleration chamber 120. The sensor assembly 164 may include only a single or multiple sensors. For example, the sensor assembly 164 may include one or more thermal conductivity gauges (e.g., Pirani gauge or thermocouple gauge). The sensor assembly 164 may include one or more ion gauges (or ionization gauges). The ion gauges may be, for example, a hot cathode ion gauge (e.g., Bayard-Alpert, triode, or Schultz-Phelps gauge) or a cold cathode gauge (e.g., Penning gauge or an inverted magnetron). The sensor assembly 164 may include one or more capacitance manometers and/or one or more Mcleod gauges and/or one or more piezo-resistive pressure sensors. The sensor assembly 164 may also include one or more residual gas analyzers. It should be understood that embodiments may use a combination of different types of sensors. For example, in some embodiments, the sensor assembly 164 includes a thermocouple gauge and an ion gauge.

The one or more sensors are configured to communicate with (e.g., transmit signals to and possibly receive signals from) the control system 112. For example, a sensor may transmit a value to the control system 112. The value may represent the operating parameter or may be used to determine an operating parameter. For example, a pressure sensor may transmit a measured pressure of the acceleration chamber. A pressure sensor may transmit a voltage that can be used to determine the pressure. A pressure sensor may transmit a value that represents a change in ion current within the sensor, which can then be used to calculate the pressure.

Although FIG. 1 illustrates the sensor assembly 164 being located fluidly between the acceleration chamber 120 and the pump assembly 162, it should be understood that one or more sensors of the sensor assembly 164 may have other positions in relation to the acceleration chamber 120 and the pump assembly 162. For example, a sensor may be positioned downstream from the pump assembly 162 and another sensor may be positioned upstream from the pump assembly 162.

To generate radioisotopes, the particle beam is directed by the radioisotope production system 100 through the extraction system 108 along a beam transport path and into the target system 110 so that the particle beam is incident upon target material located at a corresponding target location. In the illustrated embodiment, the target system 110 includes six potential target locations 150, but it should be understood that other embodiments may include a different number of target locations 150, including only one target location or more than six target locations. In some embodiments, the radioisotope production system 100 and the extraction system 108 may be configured to direct the particle beam along different paths toward the target locations 150.

As described herein, the radioisotope production system 100 may detect one or more operating parameters during operation of the cyclotron 101 (e.g., while the particle beam is directed onto the target material). The operating parameter may be, for example, a chamber pressure, a beam current, a beam profile, or an ion source drive current. In particular embodiments, multiple operating parameters are detected. For example, beam currents may be detected at a beginning point of the beam path (referenced as A in FIG. 1), at extraction points (referenced as B), at collimating points (referenced as C), or at target points (referenced as D). Points A-D may also be referred to generally as detection points. It should be understood that, depending upon the type of radioisotope production system and the operating mode of the radioisotope production system, the detection points A-D may occur at different locations. In the illustrated embodiment, the collimating point C may occur at one or more different locations (e.g., one for each collimator), and the target point D may occur at one or more different locations (e.g., one for each target).

In other embodiments, the operating parameter may be detected at another detection point. For example, a beam profile monitor may be positioned, for example, between the extraction system 108 and the target system 110 (referenced as E).

In particular embodiments, the radioisotope production system 100 brings the charged particles to a designated energy level and creates a designated beam current. For example, the radioisotope production system 100 may bring the charged particles to a designated energy with a beam current of between, for example, 10-200 μA. It should be understood that other beam currents may be possible. As to energy levels, some embodiments described herein may accelerate the charged particles to an energy of approximately 30 MeV or less. For example, the H− charged particles may be brought an energy of about 17 MeV, and the D− charged particles may be brought to an energy of about 8.5 MeV. Again, it should be understood that other energies may be achieved in alternative embodiments. For example, the radioisotope production system 100 may accelerate the charged particles to an energy of approximately 7.8 MeV or less. However, alternative embodiments may have an energy above 100 MeV, 500 MeV or more.

Optionally, the system 100 or the cyclotron 101 may include a user interface 152. The user interface 152 may be configured to communicate information to an individual and/or receive user inputs. For example, an individual may be permitted to override the production-control method described herein in which a supply of the charged particles is changed.

Figure 2:
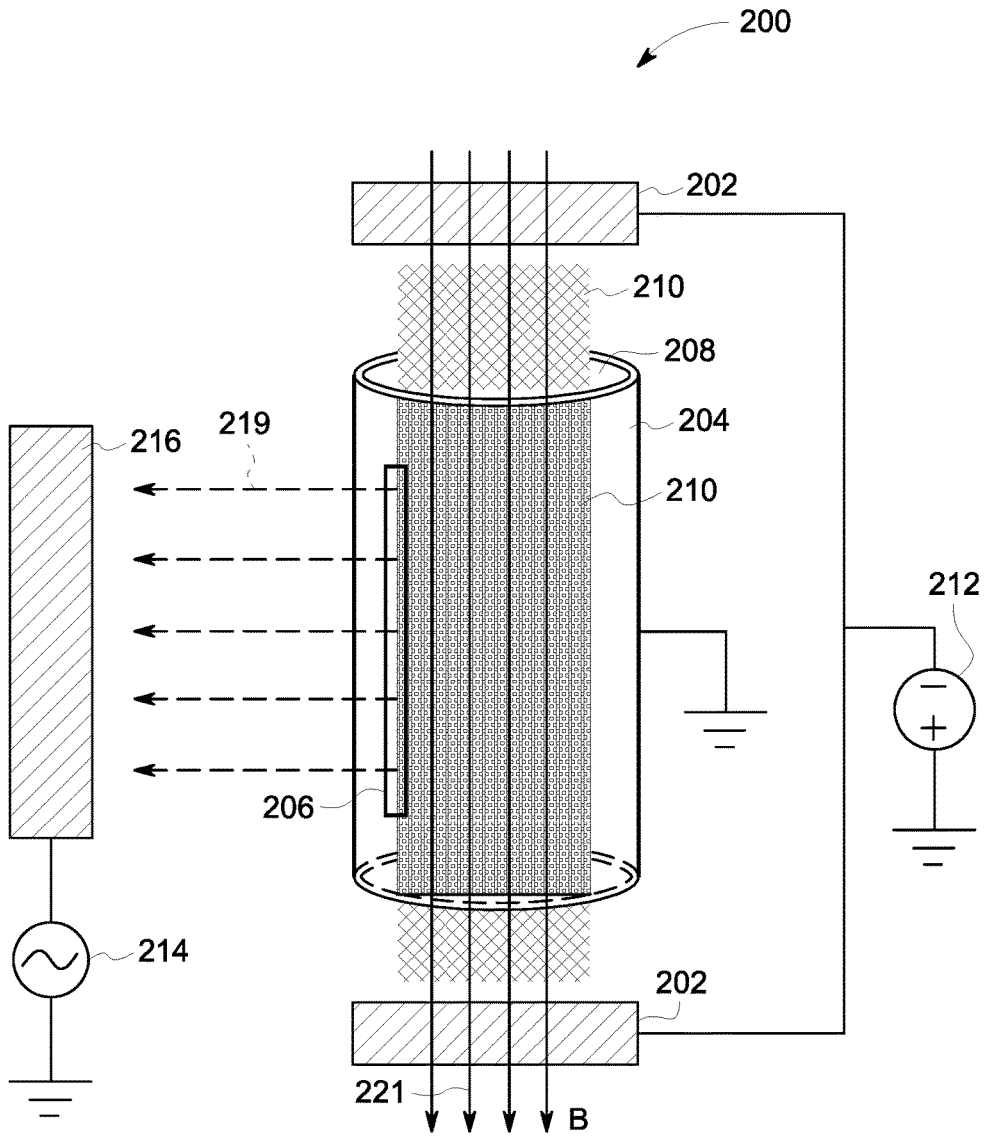
FIG. 2 is a schematic illustration of an ion source system in accordance with an embodiment.

FIG. 2 shows an ion source system 200 in accordance with an embodiment. The ion source system 106 (FIG. 1) may be similar or identical to the ion source system 200. As shown, the ion source system 200 includes an ion source tube 204, which may represent an anode, and two cathodes 202. The ion source tube 204 is positioned between the two cathodes 202. The ion source tube 204 may be grounded while the two cathodes 202 may be biased at a negative potential by a power source 212. The ion source tube 204 may have a cavity 208 into which one or more gases may be flowed. For example, a hydrogen ($H_2$) gas may be flowed into the cavity 208. The voltage difference between the cathodes 202 and the ion source tube 104 may cause a plasma discharge 210 in the hydrogen gas, creating positive hydrogen charged particles (protons) and negative hydrogen charged particles ($H^-$). The charged particles may be confined by a magnetic field 221 imposed along the length of the ion source tube 204. A puller 216, biased with a power source 214 at an alternating potential, may then extract the negative hydrogen charged particles through a slit opening 206 on the ion source tube 204. The extracted negative hydrogen charged particles 219 are further accelerated into the acceleration chamber. The ion source system 200 may be referred to as a Penning source system.

Returning to FIG. 1, the charged particles may be supplied by forming a plasma between the two opposite cathodes (not shown, such as the cathodes 202 (FIG. 2)). The cathodes are connected to an ion source power supply 144 that supplies a drive current (or ion source drive current). A concentration of negative charged particles will appear in the slit 194, and the charged particles can be extracted from the ion source system 106 by a positive potential, which is provided by the electrodes 130, 132. Charged particles exit the slit 194 and are accelerated into the orbit guided by the magnetic flux and by the electrical field, which is formed by the electrodes 130, 132.

Although the above describes one type of ion source system, it should be understood that other methods and systems may be used to provide charged particles to the acceleration chamber 120. For example, the ion source system 106 may include a magnetron, which includes a central cylindrical cathode surrounded by an anode. For either the Penning source or the magnetron, a discharge voltage is typically greater than 150 V and the current drain is around 40 A. A magnetic field of about 0.2 tesla is parallel to a cathode axis. Optionally, Caesium may be used to lower a work function of the cathode, enhancing the amount of charged particles that are produced.

Figure 3:
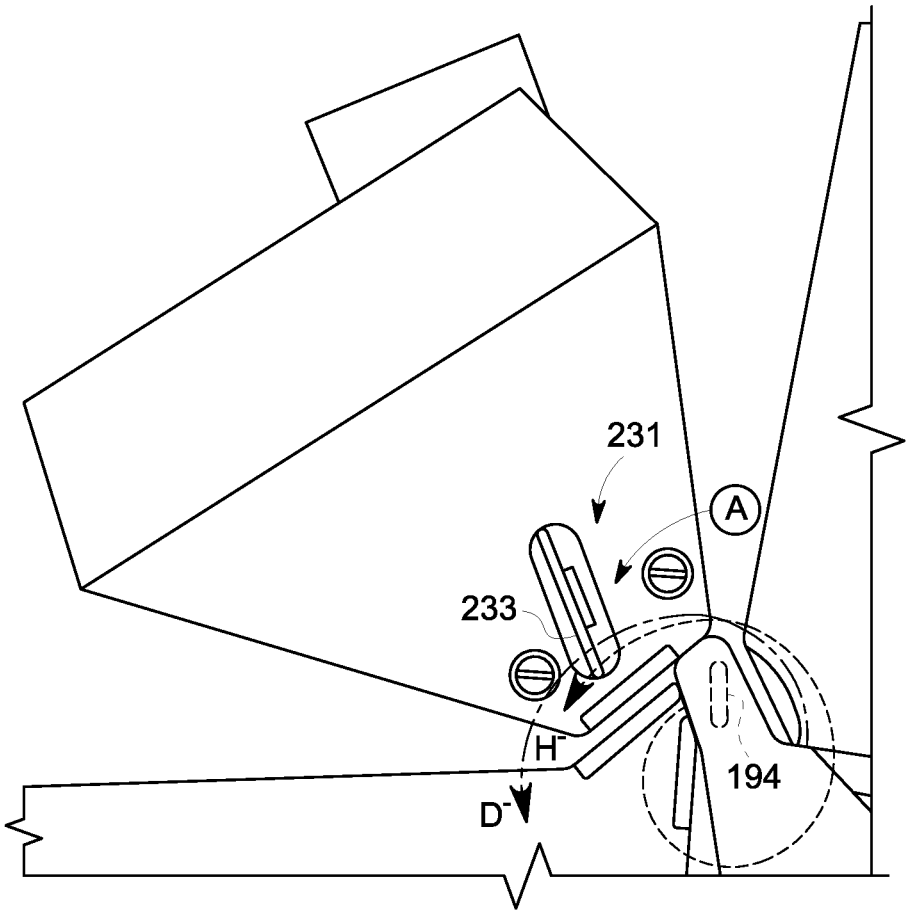
FIG. 3 is a side view of a probe that may be used with the radioisotope production system of FIG. 1.

FIG. 3 is a side view of a probe 231 that may be used with the radioisotope production system 100. The probe 231 is located at position A and may operate as a beam current valve and beam current sensor. In a blocking position (shown in FIG. 3), the probe 231 can monitor the beam current of the intercepted charged particles. The probe 231 is positioned proximate to the slit 194 of the ion source system 106, which is covered in FIG. 3, in order to block the beam at a low energy, thereby reducing the likelihood of overheating the probe 231. The probe 231 includes a blocking plate 233 that is configured to block the charged particle. The blocking plate 233 may include, for example, tantalum and/or other material. The probe 231 may be insulated from ground to enable measuring the beam current at point A. The probe 231 may include an actuator mechanism (e.g., coil actuator) (not shown) for moving the blocking plate 233 between a blocking position and an open position. In the open position, the charged particles may continue on the beam path and be directed toward the target system. The beam current data that is obtained by the probe 231 may be used to verify that the ion source system 106 is operating sufficiently.

Figure 4:
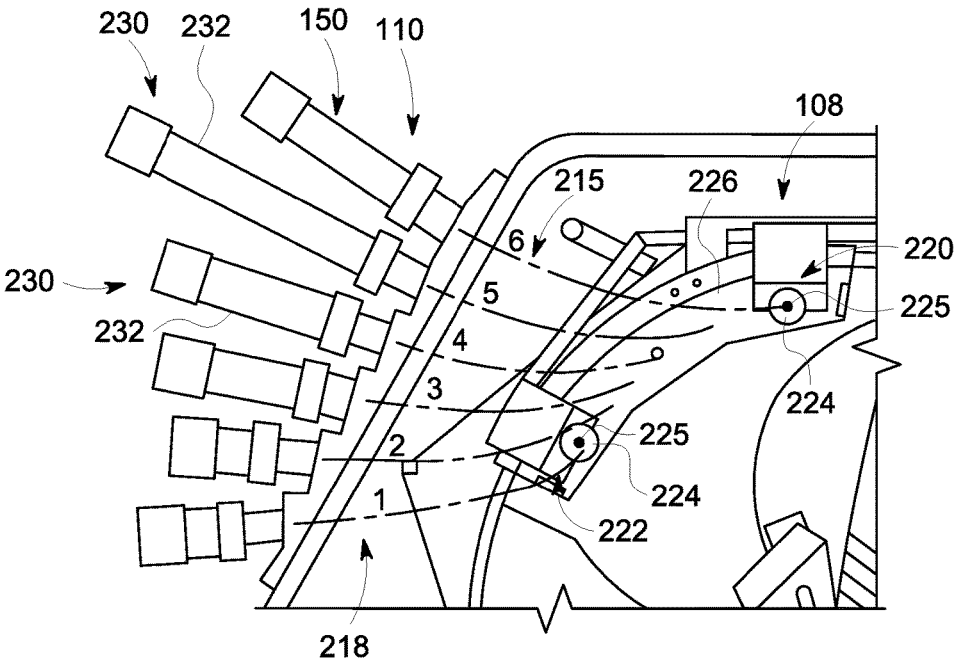
FIG. 4 is a side view of an extraction sub-system and a target sub-system that may be used with the radioisotope production system of FIG. 1.

FIG. 4 is a side view of the extraction system 108 and the target system 110. In the illustrated embodiment, the extraction system 108 includes first and second extraction units 220, 222 that each includes a foil holder 224 and one or more extraction foils (not shown). The extraction process may be based on a stripping-foil principle. More specifically, the electrons of the charged particles (e.g., the accelerated negative charged particles) are stripped as the charged particles pass through an extraction foil. The charge of the particles is changed from a negative charge to a positive charge thereby changing the trajectory of the particles in the magnet field. The extraction foils may be positioned to control a trajectory of an external particle beam 215 that includes the positively-charged particles and may be used to steer the external particle beam 215 toward designated target locations 150.

In the illustrated embodiment, the foil holders 224 are rotatable carousels that are capable of holding one or more extraction foils. However, the foil holders 224 are not required to be rotatable. The foil holders 224 may be selectively positioned along a track or rail 226. The extraction system 108 may have one or more extraction modes. For example, the extraction system 108 may be configured for single-beam extraction in which only one external particle beam 215 is guided to an exit port 218. In FIG. 4, there are six exit ports 218, which are enumerated as 1-6.

The extraction system 108 may also be configured for dual-beam extraction in which two external beams 215 are guided simultaneously to two exit ports 218. In a dual-beam mode, the extraction system 108 may selectively position the extraction units 220, 222 such that each extraction unit intercepts a portion of the particle beam (e.g., top half and bottom half). The extraction units 220, 222 are configured to move along the track 226 between different positions. For example, a drive motor may be used to selectively position the extraction units 220, 222 along the track 226. Each extraction unit 220, 222 has an operating range that covers one or more of the exit ports 218. For example, the extraction unit 220 may be assigned to the exit ports 4, 5, and 6, and the extraction unit 222 may be assigned to the exit ports 1, 2, and 3. Each extraction unit may be used to direct the particle beam into the assigned exit ports.

The foil holders 224 may be insulated to allow for current measurement of the stripped-off electrons. The extraction foils are located at a radius of the beam path where the beam has reached a final energy. In the illustrated embodiment, each of the foil holders 224 holds a plurality of extraction foils (e.g., six foils) and is rotatable about an axis 225 to enable positioning different extraction foils within the beam path.

The target system 110 includes a plurality of target assemblies 230. A total of six target assemblies 230 are shown and each corresponds to a respective exit port 218. When the particle beam 215 has passed the selected extraction foil, it will pass into the corresponding target assembly 230 through the respective exit port 218. The particle beam enters a target chamber (not shown) of a corresponding target body 232. The target chamber holds the target material (e.g., liquid, gas, or solid material) and the particle beam is incident upon the target material within the target chamber. The particle beam may first be incident upon one or more foils within the target body 232. The target assemblies 230 are electrically insulated to enable detecting a current of the particle beam when incident on the target material, the target body 232, and/or foils within the target body.

Figure 5:
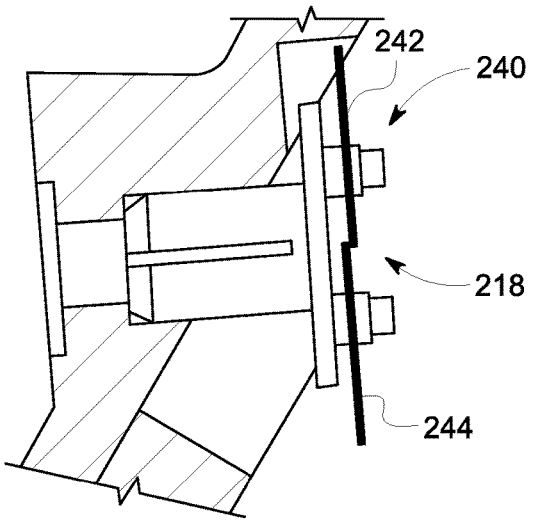
FIG. 5 is a side cross-sectional view of a collimator assembly that may be used with the radioisotope production system of FIG. 1.

FIG. 5 is a side cross-sectional view of an exemplary collimator assembly 240 that may be positioned at a corresponding exit port 218. As shown, the collimator assembly 240 includes two beam collimators 242, 244 that are mounted to the target system 110. Other embodiments may include only one beam collimator or more than two beam collimators. The beam collimators 242, 244 may be referred to as upper and lower beam collimators 242, 244, respectively. In the illustrated embodiment, each of the beam collimators 242, 244 has two functions. First, the beam collimators 242, 244 may define beam boundaries. More specifically, a size of a hole through each of the upper and lower collimators 242, 244 may define a portion of the outer boundary of the particle beam and, consequently, the size of the beam spot that is incident upon foils in the target chamber. Second, the collimators are insulated from ground. The portions of the particle beam that are intercepted by the collimators 242, 244 may be detected and may represent a portion of a total target current. Moreover, a monitoring system 250 (shown in FIG. 6) may measure possible unbalances in the particle beam based on the currents detected by the collimators 242, 244. The monitoring system 250 may then re-position the particle beam accordingly until the measurements obtained by the collimators indicate that the particle beam is sufficiently balanced. For example, the particle beam may be balanced when the collimators detect the same current value.

Figure 6:
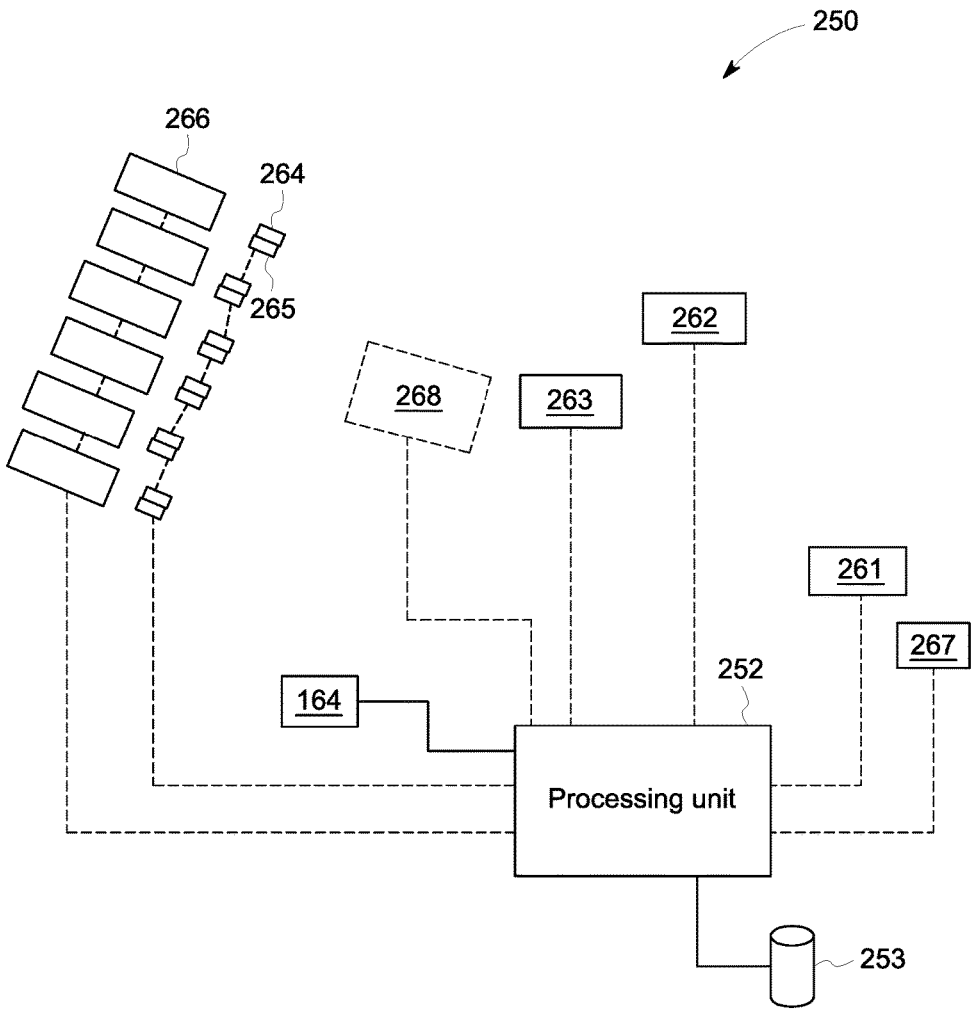
FIG. 6 is a block diagram of a monitoring system that may be used with the radioisotope production system of FIG. 1.

FIG. 6 is a schematic diagram of a monitoring system 250 that may be used with the radioisotope production system 100. The monitoring system 250 may be a portion of the control system 112 (FIG. 1). As shown, the monitoring system 250 includes a processing unit 252. The processing unit 252 is configured to receive data regarding one or more operating parameters from one or more sensors. In the illustrated embodiment, the processing unit 252 may receive a beam current reading from a sensor 261 in the probe 231 (illustrated in FIG. 3), one or more beam current readings from sensors 262, 263 of the extraction units 220, 222 (illustrated in FIG. 4), beam current readings from sensors 264, 265 of the collimators 242 or 244 (illustrated in FIG. 5), and a beam current reading from sensor 266 of a corresponding target body 232 (illustrated in FIG. 4). An ion source current may be detected by a sensor 267. The sensors 261-267 may be, for example, current-to-voltage converters that are each operably coupled to a conductive surface that receives current from the particle beam.

Alternatively or in addition to one or more of the above readings, the processing unit 252 may receive a reading from the sensor assembly 164. For example, readings may be provided by one or more sensors of the sensor assembly 164. Such sensors may include a thermal conductivity gauge (e.g., Pirani gauge or thermocouple gauge), a Mcleod gauge, a piezo-resistive pressure sensor, a residual gas analyzer, or an ion gauge, such as a hot cathode ion gauge (e.g., Bayard-Alpert, triode, or Schultz-Phelps gauge) or a cold cathode gauge. If the sensor assembly 164 includes multiple sensors, the sensor assembly 164 may communicate a plurality of readings at or near the same time or a single reading that is based on multiple measurements from the multiple sensors at or near the same time.

Alternatively or in addition to one or more of the above beam current readings, the processing unit 252 may receive a beam profile reading from a beam profile monitor 268. A beam profile describes a relative beam distribution over a designated cross-sectional area of the beam. The designated area may be, for example, within the target system, proximate to the target system, or immediately after the extraction system. The beam profile may include one or more wires or electrodes that have the particle beam incident thereon. Some beam profile monitors include an array or mesh of wires that is positioned to intercept the particle beam.

The readings may be referred to more specifically in the description and claims. For example, a reading from the sensor assembly 164 may be referred to as a vacuum reading or a pressure reading. A beam current reading from the sensor 261 of the probe 231 may be referred to as a probe current. The beam current reading from the extraction system 108 may be referred to as an extraction current (or foil current). The beam current reading from the collimators 242, 244 may be referred to as a collimator current, and the beam current reading from the target body 232 may be referred to as a target current. The monitoring system 250 is configured to analyze the readings to determine a quality or status of the particle beam. As described herein, the monitoring system 250 may also analyze the readings to determine a desired drive current for the magnetic field system 102.

As used herein, a "processing unit" includes processing circuitry configured to perform one or more tasks, functions, or steps, such as those described herein. For instance, the processing unit may be a logic-based device that performs operations based on instructions stored on a tangible and non-transitory computer readable medium, such as memory 253. The processing unit may also be a hard-wired device (e.g., electronic circuitry) that performs the operations based on hard-wired logic that is configured to perform the algorithms and/or methods described herein. The processing unit may include one or more ASICs and/or FPGAs. It may be noted that "processing unit," as used herein, is not intended to necessarily be limited to a single processor or a single hard-wired device. For example, the processing unit may include a single processor (e.g., having one or more cores), multiple discrete processors, one or more application specific integrated circuits (ASICs), and/or one or more field programmable gate arrays (FPGAs). In some embodiments, the processing unit is an off-the-shelf device that is appropriately programmed or instructed to perform operations, such as the algorithms described herein.

It is noted that operations performed by the processing unit (e.g., operations corresponding to the methods/algorithms described herein, or aspects thereof) may be sufficiently complex that the operations may not be performed by a human being within a reasonable time period based on the intended application of the radioisotope production system. The processing unit may be configured to receive signals (e.g., data or information) from the various sub-systems. The processing unit may also be configured to perform one or more steps of the methods set forth herein.

Processing units may also include or be communicatively coupled to the memory 253. In some embodiments, the memory 253 may include non-volatile memory. For example, the memory may be or include read-only memory (ROM), random-access memory (RAM), electrically erasable programmable read-only memory (EEPROM), flash memory, and the like. The memory 253 may be configured to store data regarding various parameters of the system.

Figure 7:
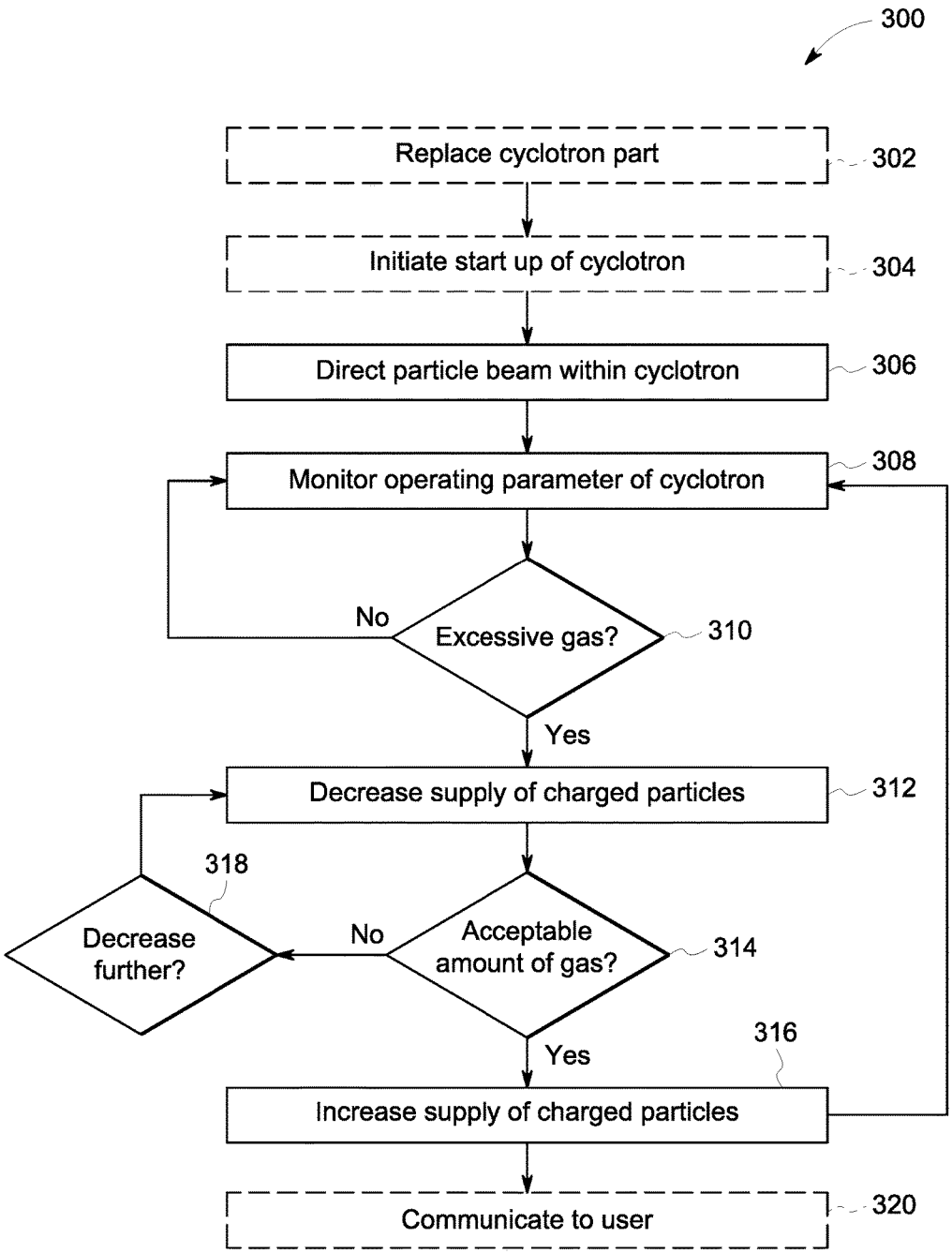
FIG. 7 is a flow chart of a method in accordance with an embodiment that may be conducted by the cyclotron of FIG. 1.

FIG. 7 is a flow chart of a method 300 in accordance with an embodiment that may be performed by the radioisotope production system 100 (FIG. 1) and/or the cyclotron 101 (FIG. 1). The method 300 may employ structures or aspects of various embodiments (e.g., systems or cyclotrons) described herein. In various embodiments, certain steps of the methods may be omitted or added, certain steps may be combined, certain steps may be performed simultaneously, certain steps may be performed concurrently, certain steps may be split into multiple steps, certain steps may be performed in a different order, or certain steps or series of steps may be re-performed in an iterative fashion.

Optionally, the method 300 may include replacing, at 302, a used cyclotron part with a new cyclotron part. Alternatively, the method may include installing the cyclotron in which the installed cyclotron has new cyclotron parts. For example, the method 300 may be at least partially performed or managed by a technician that is installing, servicing, or repairing the cyclotron. The method 300 may be performed to test and/or tune operation of the cyclotron. The gas generation may be caused by outgassing, degassing, desorption and/or leaks.

In some embodiments, the method 300 may be employed throughout operation of the cyclotron. For example, small leakages to the acceleration chamber may develop over time, thereby causing the pressure in the acceleration chamber to increase and the production capacity of the cyclotron to decrease. Accordingly, embodiments may reduce production when an unacceptable level of pressure exists within the acceleration chamber.

The method 300 may include initiating, at 304, a start-up procedure. The start-up procedure may include, among other things, evacuating the acceleration chamber until the chamber pressure is within an acceptable range, such as $5\times10^{-7}\pm2\times10^{-7}$ millibar (or $5\times10^{-5}\pm2\times10^{-5}$ Pa). The acceptable range may be adjusted by an individual. For example, an operator may enter (e.g., through the user interface) the acceptable range of chamber pressure. In some cases, the acceptable range is automatically determined by the selected operating mode. However, after selecting the operating mode, the operator may be permitted to change the acceptable range.

In some embodiments, the acceleration chamber is evacuated for at least 20 minutes prior to executing a first production cycle. However, the acceleration chamber may be evacuated for a longer time period (e.g., at least 30 minutes) or for a shorter time period (e.g., less than 20 minutes).

At 306, a particle beam of charged particles is generated by an electrical field system and a magnetic field system of a cyclotron and directed along a beam path. The directing, at 306, may include operating the cyclotron at a planned operating mode. A planned operating mode includes specified parameters that determine the beam path and quality and/or shape of the particle beam. As described above, the magnetic field system may be energized by a drive current to generate a magnetic flux. The strength of the magnetic flux is a function of the drive current, which is one operating parameter. Other parameters that determine the particle beam include the supply (e.g., flow rate and/or pressure) of the charged particles, the oscillating frequency of the electrical field, and shape of the magnet poles. The planned operating mode may be a start-up mode for radioisotope production embodiments that are preparing to execute a first production cycle.

At 308, an operating parameter of the particle beam may be monitored as the particle beam is directed by the cyclotron. In some cases, the operating parameter may be repeatedly determined as the particle beam is incident upon the target system. The operating parameter may be, for example, a chamber pressure of the acceleration chamber. Another operating parameter may be a beam current at one or more points along the beam path of the particle beam, such as one or more of the points A, B, C, or D. The cyclotron may also be operated in dual-beam mode. The operating parameter may be the ion source current that is supplied to an ion source system. The operating parameter may also be derived from data provided by a beam-profile monitor. The operating parameter may also be a beam quality factor, which may be based on a plurality of operating parameters. For example, the beam quality factor may be based on a beam current detected at one or more points along the beam path and an ion source drive current. The beam quality factor may also be based on data from a beam-profile monitor. The beam quality factor may also be based on a variety of beam parameters, such as intensity, emittance, and modulation.

It should be understood, however, that the operating parameters are not limited to a chamber pressure, a beam current, an ion source drive current, or data from the beam profile monitor. Instead, any measurable or determinable (e.g., calculable) operating parameter that may be used to determine whether an excessive amount of residual gas molecules exist within the acceleration chamber may be used. Embodiments may use any combination of operating parameters.

The monitoring, at 308, of the operating parameter may include determining only one operating parameter (e.g., chamber pressure of the acceleration chamber) or may include determining multiple operating parameters (e.g., chamber pressure of the acceleration chamber, beam current at the extraction system, beam current at the collimator, and an ion source current). The operating parameter (or parameters) may be associated with an amount of gas molecules within the acceleration chamber. As such, decisions on how and when to change the operation of the cyclotron may be based on the operating parameter or parameters.

Accordingly, monitoring an operating parameter, at 308, may include monitoring multiple operating parameters. As one example, a first operating parameter may be a chamber pressure. A second operating parameter may be a beam current (or multiple beam currents) detected at the extraction system. A third operating parameter may be a beam current detected one of the collimators, and a fourth operating parameter may be the beam current at the other collimator. A fifth operating parameter may be an ion source current of an ion source system.

As the operating parameter is monitored, at 308, the control system may determine, at 310, whether an excessive amount of gas exists within the acceleration chamber. This determination may be performed by analyzing the operating parameter(s). For example, if the pressure of the acceleration chamber has not exceeded a designated threshold, it may be determined that an excessive amount of gas does not presently exist within the acceleration chamber. The method 300 may return to monitoring, at 308, the operating parameter. If a pressure of the acceleration chamber has exceeded a designated threshold, it may be determined that an excessive amount of gas exists within the acceleration chamber. For example, a pressure reading of the acceleration chamber may be outside of an acceptable range (e.g., too high).

After determining that an excessive amount of gas exists within the acceleration chamber, the method 300 may decrease (reduce), at 312, a supply of the charged particles to the acceleration chamber. After decreasing the supply of the charged particles, the particle beam may continue to be directed along the beam path at 302. For embodiments operating at a planned operating mode, the planned operating mode may be interrupted. The amount of decrease may be predetermined or may be based on the operating parameter. To decrease the supply, an electrical characteristic (e.g., an ion source current) of the ion source system may be changed. Alternatively or in addition to reducing the ion source current, a pressure or flow rate of the gas that is used to generate the charged particles may be adjusted (e.g., reduced). As an example, decreasing the supply of the charged particles, at 312, may include decreasing the supply of charged particles by at least 20%. In some embodiments, the supply is decreased by at least 25% or by at least 30%. In certain embodiments, the supply is decreased by at least 35% or by at least 50%. In particular embodiments, the supply is decreased by at least 60%. In other embodiments, however, the supply may be decreased by less than 20%.

In some embodiments, the supply may be gradually reduced. For example, the supply may be gradually reduced until the control system determines that the pressure of the acceleration chamber is decreasing. In some embodiments, the supply may be reduced in increments. For example, the supply may be initially reduced by 20% and then reduced an additional 5% every thirty seconds until the control system determines that the pressure of the acceleration chamber is decreasing.

In some cases, decreasing the supply, at 312, may include at least one of changing a current of the ion source system, a voltage of the ion source system, a pressure of a gas in the ion source system, or a flow rate of the gas in the ion source system. It is understood that other actions may be implemented to decrease the supply of the charged particles.

At 314, the control system may determine whether an acceptable amount of gas exists within the acceleration chamber. The amount of gas may be determined by analyzing one or more operating parameters. The operating parameter may or may not include the operating parameter that was monitored at 308. If an acceptable amount of gas exists within the acceleration chamber, the method 300 may increase, at 316, a supply of the charged particles. If an unacceptable amount of gas exists within the acceleration chamber, the method 300 may further decrease, at 318, the supply of the charged particles.

In some embodiments, the supply is increased only after a designated time period (e.g., 5 minutes, 10 minutes, 20 minutes, or more). Alternatively or in addition increasing the supply after a designated period of time, the supply of the charged particles may be increased in response to determining an operating parameter that indicates the amount of gas molecules has reduced to an acceptable level. The operating parameter may be the same or different operating parameter used at 308.

Decisions made to decrease the supply or increase the supply at 312, 316, respectively, may be determined by the control system (e.g., by the processing circuit of the control system). The decisions may be based on at least one operating parameter. As used herein, the phrase "based on at least one operating parameter" includes making a decision based on only one operating parameter or based on multiple operating parameters. The phrase "based on at least one operating parameter" also includes making a decision by comparing the one or more operating parameters to limits or thresholds or by applying the one or more operating parameters to an objective function.

In some embodiments, the operating parameter is a beam quality factor. The beam quality factor represents a status of the particle beam relative to a desired particle beam or desired qualities of the particle beam. For example, during operation, the particle beam may become misaligned, a profile of the particle beam may become misshaped, or an intensity of the particle beam may decrease. As the particle beam becomes more misaligned, more misshaped, or decrease in intensity, the beam quality factor decreases. As the particle beam becomes better aligned better shaped, the beam quality factor may increase.

The beam quality factor may be calculated using readings obtained by the monitoring system 250. For example, in some embodiments, the beam quality factor (BQF) may be calculated using the formula:

$$BQF = \frac{(I_T - I_{C1} - I_{C2})}{I_{IS}}$$

wherein $I_T$ may be a target current; $I_{C1}$ may be a collimator current; $I_{C2}$ may be another collimator current; and $I_{IS}$ may be a drive current of the ion source system. The drive current of the ion source system is indicative of an output of the ion source system. It is noted that the above formula is just one example and that the formula may be modified or another formula may be used based upon the application of the system. For example, during two-beam extraction the formula may be a function of two pairs of collimator currents and the two target currents.

At 320, optionally, a user interface of the cyclotron (or radioisotope production system) may notify a user of the cyclotron or system that the cyclotron system operated at a reduced supply of the charged particles. The notification may include information, such as the time period in which the cyclotron operated at a reduced supply.

Optionally, the user interface may be configured to receive user inputs for controlling the particle beam. For example, the control system may be configured to override, based upon the user inputs, the production-control features that decrease the supply of the charged particles.

Figure 9:
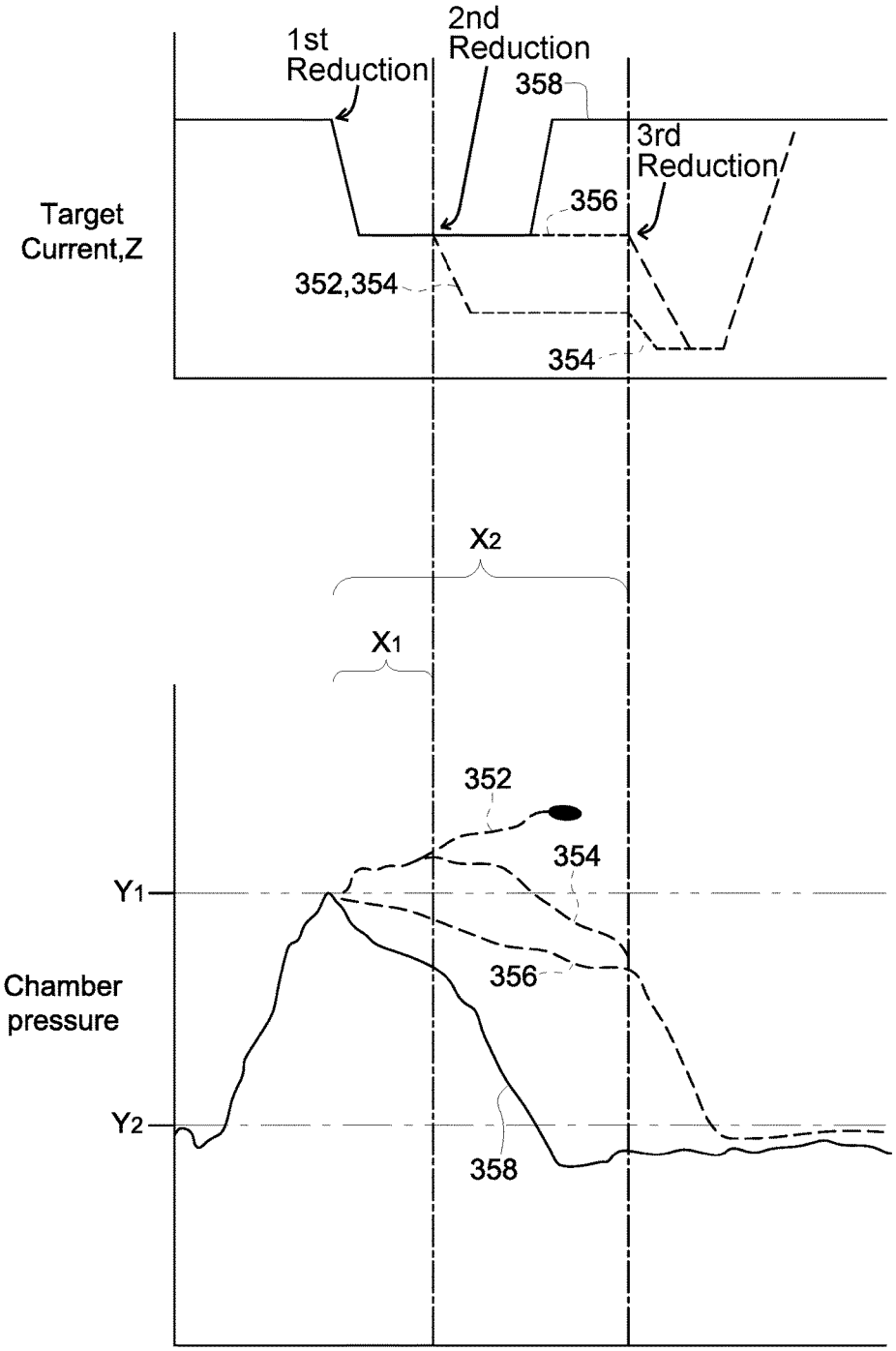
FIG. 9 illustrates a graph of chamber pressure and a graph of target current as the method of FIG. 7 is implemented.

FIG. 9 illustrates one example of the method of FIG. 7. FIG. 9 shows a graph for chamber pressure and a graph for target current. An individual, through user inputs, may set desired operational values for the chamber pressure. In FIG. 9, $Y_1$ is the value of the chamber pressure when the production-control portion of the method will be triggered, and $Y_2$ is the value of the chamber pressure in which the cyclotron will return to normal production (e.g., the operating mode prior to the production-control portion be triggered). $Y_2$ may be referred to as an acceptable value. $Y_1$ and $Y_2$ may be, for example, within $5\times10^{-5}\pm2\times10^{-5}$ Pa. $Y_1$ is greater than $Y_2$. Z is a target current detected at the target during operation. As described above, the control system (or monitoring system) may determine that an excessive amount of gas exists within the chamber, at 310 (FIG. 7), when the chamber pressure exceeds the upper limit $Y_1$. As described herein, however, the production-control portion of the method may be triggered using other operating parameters.

In response to determining that an excessive amount of gas exists within the chamber, the ion source current is controlled (e.g., regulated), at 312 (FIG. 7), such that the supply of gas is reduced. For example, the ion source current may be reduced until the target current Z obtains a designated value. The designated value may be a percentage of the target current when the production-control portion was triggered. Alternatively, the designated value may be a predetermined value regardless of the target current when the production-control portion is triggered. As a specific example, the new target current may be 50% of the prior target current, but other values may be selected. If the cyclotron is using two targets (e.g., dual-beam), the ion source current may be reduced until (a) at least one of the target currents obtains the designated value or (b) each of the target currents obtains the designated value.

The cyclotron may continue operation for a designated time period $X_1$ (e.g., two minutes) after obtaining the new target current or, alternatively, after the production-control is triggered. After the time period $X_1$, the chamber pressure may be determined. Various circumstances may occur. In one example, if it is determined that the chamber pressure increased after initially reducing the target current, the ion source current may be reduced again until the target current obtains a lower designated value (e.g., 50% of the new starting point). If the chamber pressure continues to increase after reducing a second time (as shown by segment 352), the cyclotron may immediately shut down or automatically shut down after, for example, the chamber pressure exceeds an upper limit or the chamber pressure does not decrease within a designated time period. Segment 354 shows an example in which the chamber pressure decreased only after the target current is reduced a second time.

As example, if the chamber pressure does not obtain $Y_2$ within a designated test period $X_2$ (e.g., ten minutes) (as shown by segment 356), the ion source current may be reduced again until the target current obtains a designated value (e.g., 50% again). In any of the above examples, when it is determined that the chamber pressure has lowered below $Y_2$, the ion source current may be controlled (e.g., increased) until the target current reaches the original operating target current. This may occur at any time after the time period $X_1$. Segment 358 shows an example in which the chamber pressure began to decrease immediately and decreased below $Y_2$ prior to the test period $X_2$ elapsing.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the inventive subject matter without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the inventive subject matter should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f) unless and until such claim limitations expressly use the phrase "means for" followed by a statement of function void of further structure.

This written description uses examples to disclose the various embodiments, and also to enable a person having ordinary skill in the art to practice the various embodiments, including making and using any devices or systems and performing any incorporated methods. The patentable scope of the various embodiments is defined by the claims, and may include other examples that occur to those skilled in the art. Such other examples are intended to be within the scope of the claims if the examples have structural elements that do not differ from the literal language of the claims, or the examples include equivalent structural elements with insubstantial differences from the literal languages of the claims.

The foregoing description of certain embodiments of the present inventive subject matter will be better understood when read in conjunction with the appended drawings. To the extent that the figures illustrate diagrams of the functional blocks of various embodiments, the functional blocks are not necessarily indicative of the division between hardware circuitry. Thus, for example, one or more of the functional blocks (for example, processors or memories) may be implemented in a single piece of hardware (for example, a general purpose signal processor, microcontroller, random access memory, hard disk, or the like). Similarly, the programs may be standalone programs, may be incorporated as subroutines in an operating system, may be functions in an installed software package, or the like. The various embodiments are not limited to the arrangements and instrumentality shown in the drawings.

What is claimed is:

1. A cyclotron comprising:

an acceleration chamber;

a vacuum system in flow communication with the acceleration chamber and configured to evacuate the acceleration chamber;

an ion source system configured to provide charged particles to the acceleration chamber;

an electrical field system and a magnetic field system configured to direct a particle beam formed from the charged particles, the particle beam being directed along a beam path within the acceleration chamber; and a control system configured to determine at least one operating parameter as the particle beam is directed along the beam path, the at least one operating parameter being associated with an amount of gas molecules within the acceleration chamber, the control system configured to:

decrease a supply of the charged particles for the particle beam based on the at least one operating parameter, the particle beam continuing to be directed along the beam path after decreasing the supply of the charged particles; and increase the supply of the charged particles for the particle beam after a predetermined time period and/or in response to determining that the amount of gas molecules has reduced based on the at least one operating parameter.

2. The cyclotron of claim 1, wherein decreasing the supply of the charged particles includes reducing the supply of charged particles by at least 20%.

3. The cyclotron of claim 1, wherein the control system is configured to operate the cyclotron in accordance with a planned operating mode, the control system interrupting the planned operating mode when decreasing the supply of the charged particles.

4. The cyclotron of claim 1, wherein at least one of decreasing or increasing the supply of the charged particles by the control system is based upon one or more parts of the cyclotron that have been recently replaced, the control system at least one of detecting the one or more parts that have been replaced or receiving user inputs indicating the one or more parts that have been replaced.

5. The cyclotron of claim 1, wherein the at least one operating parameter includes at least one of a chamber pressure of the acceleration chamber, an ion source current, one or more beam currents detected along or near the beam path, a beam profile of the particle beam, or a beam quality factor.

6. The cyclotron of claim 1, wherein the operating parameter includes at least one of a chamber pressure of the acceleration chamber or a beam current at an extraction system.

7. The cyclotron of claim 1, wherein decreasing or increasing the supply of the charged particles by the control system includes at least one of changing a current of the ion source system, a voltage of the ion source system, a pressure of a gas in the ion source system, or a flow rate of the gas in the ion source system.

8. The cyclotron of claim 1, wherein, after decreasing the supply of the charged particles a first time, the control system is configured to decrease the supply of the charged particles a second time in response to determining that the operating parameter did not substantially change after decreasing the supply of the charged particles the first time.

9. The cyclotron of claim 1, further comprising a user interface that is configured to notify a user of the cyclotron that the cyclotron operated at a reduced supply of the charged particles.

10. The cyclotron of claim 1, further comprising a user interface that is configured to receive user inputs, the control system configured to override, based upon the user inputs, decreasing the supply of the charged particles based on the at least one operating parameter.

11. A cyclotron comprising:

an acceleration chamber;

a vacuum system in flow communication with the acceleration chamber and configured to evacuate the acceleration chamber;

an ion source system configured to provide charged particles to the acceleration chamber;

an electrical field system and a magnetic field system configured to direct a particle beam formed from the charged particles, the particle beam configured to be directed along a beam path within the acceleration chamber; and a control system configured to determine a chamber pressure of the acceleration chamber as the particle beam is directed along the beam path, the control system configured to:

decrease supply of the charged particles to the acceleration chamber in response to determining that the chamber pressure is excessive; and increase the supply of the charged particles to the acceleration chamber in response to determining that the chamber pressure has reduced to an acceptable value.

12. The cyclotron of claim 11, wherein decreasing the supply of the charged particles includes reducing the supply of charged particles by at least 20%.

13. The cyclotron of claim 11, wherein decreasing or increasing the supply of the charged particles by the control system is also based on an operating parameter, the operating parameter including at least one of an ion source current, one or more beam currents detected along or near the beam path, a beam profile of the particle beam, or a beam quality factor.

14. The cyclotron of claim 11, wherein decreasing or increasing the supply of the charged particles by the control system includes at least one of changing a current of the ion source system, a voltage of the ion source system, a pressure of a gas in the ion source system, or a flow rate of the gas in the ion source system.

15. The cyclotron of claim 11, wherein the control system is configured to operate the cyclotron in accordance with a planned operating mode, the control system interrupting the planned operating mode when decreasing the supply of the charged particles.

16. The cyclotron of claim 11, wherein, after decreasing the supply of the charged particles a first time, the control system is configured to decrease the supply of the charged particles a second time in response to determining that the chamber pressure did not substantially change after decreasing the supply of the charged particles the first time.

17. A method comprising:

directing a particle beam of charged particles in an acceleration chamber using an electrical field system and a magnetic field system, the acceleration chamber being evacuated by a vacuum system, the charged particles being supplied by an ion source system to the acceleration chamber;

monitoring at least one operating parameter as the particle beam is directed within the acceleration chamber, the at least one operating parameter being associated with an amount of gas molecules within the acceleration chamber, the method further comprising:

decreasing a supply of the charged particles to the acceleration chamber based upon the at least one operating parameter, the particle beam continuing to be directed along a beam path after decreasing the supply of the charged particles; and increasing the supply of the charged particles after a predetermined time period and/or in response to determining that the amount of gas molecules has reduced based on the at least one operating parameter.

18. The method of claim 17, wherein decreasing the supply of the charged particles includes reducing the supply of charged particles by at least 20%.

19. The method of claim 17, wherein decreasing or increasing the supply of the charged particles includes at least one of changing a current of the ion source system, a voltage of the ion source system, a pressure of a gas in the ion source system, or a flow rate of the gas in the ion source system.

20. The method of claim 17, wherein the particle beam is directed in accordance with a planned operating mode, the planned operating mode being interrupted when decreasing the supply of the charged particles.

* * * * *